United States Patent [19]

Lemaire

[11] 4,183,432

[45] Jan. 15, 1980

[54] TRANSPARENT CONTAINER FOR HOLDING A PREDETERMINED QUANTITY OF COINS

[76] Inventor: Réal F. Lemaire, 4711 Blvd. Allard, Drummondville, Quebec, Canada

[21] Appl. No.: 953,930

[22] Filed: Oct. 23, 1978

Related U.S. Application Data

[63] Continuation-in-part of Ser. No. 911,700, Jun. 1, 1978, abandoned.

[51] Int. Cl.[2] ..... A45C 11/28

[52] U.S. Cl. ..... 206/0.82; 229/93

[58] Field of Search ..... 206/0.82, 0.83, 0.84, 206/459; 133/1 A; 229/2.5, 93

[56] References Cited

U.S. PATENT DOCUMENTS

| | | | |
|---|---|---|---|
| 667,104 | 1/1901 | Schlemmer | 206/0.82 |
| 712,087 | 10/1902 | O'Neill | 206/0.82 |
| 1,010,346 | 11/1911 | Burn | 206/0.82 |
| 1,076,400 | 10/1913 | Wilton | 206/0.82 |
| 3,164,478 | 1/1965 | Bostrom | 229/2.5 |
| 4,139,093 | 2/1979 | Holmes | 206/0.82 |

*Primary Examiner*—Herbert F. Ross

*Attorney, Agent, or Firm*—Alan Swabey; Robert Mitchell; Guy J. Houle

[57] ABSTRACT

A re-usable transparent coin holder comprising two open-faced receptacles formed from a transparent plastics material. The receptacles are interconnected along a common edge and each receptacle has a substantially semi-cylindrical side wall. A substantially semi-circular end wall is provided at opposite ends of each side wall. Each end wall slopes outwardly towards a top edge of the receptacle and an end rib is provided in the end wall of at least one of the receptacles and disposed adjacent at least a portion of the side wall and extending transverse to the side wall whereby to retain an exact quantity of coins when stacked side-by-side in close fit across the side wall and transverse to the plane thereof between the end walls. The side walls of the receptacles form one or more closed hollow cylindrical compartments when the receptacles are folded together from the common edge and secured in juxtaposition.

13 Claims, 8 Drawing Figures

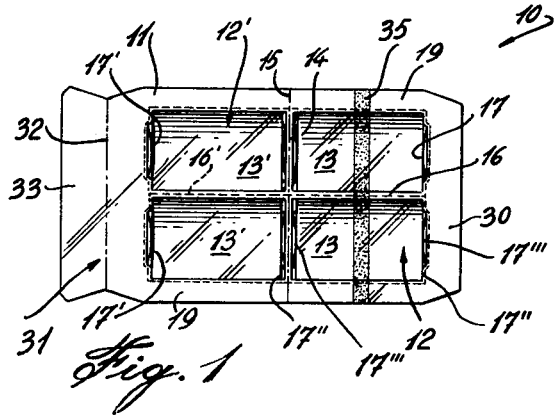
Fig. 1
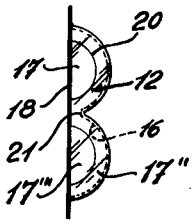
Fig. 2
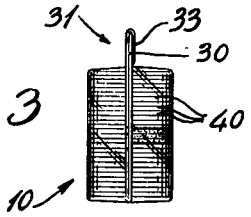
Fig. 3
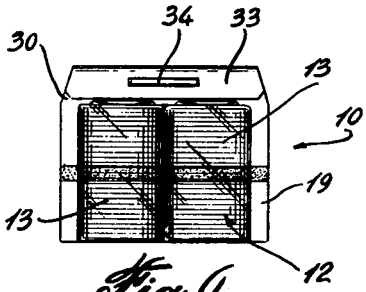
Fig. 4
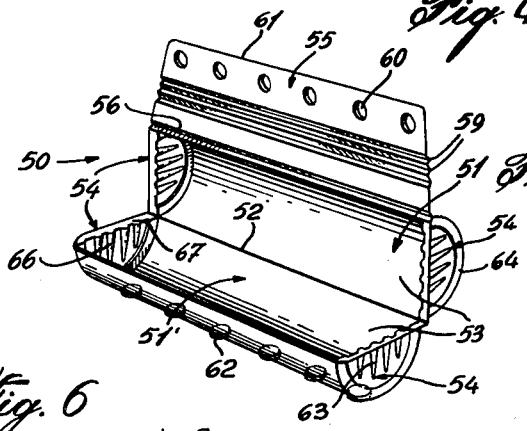
Fig. 5
Fig. 6
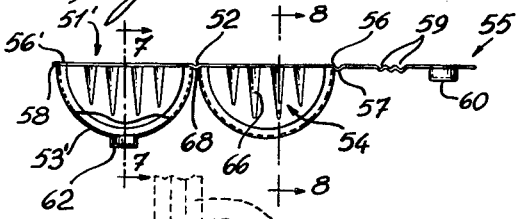
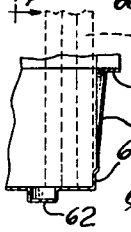
Fig. 7
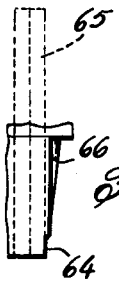
Fig. 8

TRANSPARENT CONTAINER FOR HOLDING A PREDETERMINED QUANTITY OF COINS

CROSS-REFERENCE TO RELATED APPLICATION

This is a continuation-in-part of parent application Ser. No. 911,700, filed June 1, 1978, now abandoned.

BACKGROUND OF INVENTION (a) Field of the Invention

The present invention relates to a re-usable transparent coil holder for holding a predetermined number of coins in a securable manner.

(b) Description of Prior Art

Various types of coin holders have been heretofore provided. Some of the disadvantages of known coin holders are that the type which are tubular are normally formed of an opaque material, therefore, not providing the visibility of the contents of the holder. The result is that a false quantity of coins can be fraudulently represented with such holders. Also, the denomination of the coins cannot be visually ascertained when different denomination coins are of similar sizes.

A further disadvantage of some known coin holders is that these are difficult to assemble, usually being provided in parts or in a blank form, thus requiring an assembly of the holder prior to the insertion of coins therein. Still further, some of these holders do not positively lock the coins therein and sometimes the holder will become detached and its contents will fall out when subjected to small jolts. Furthermore, known holders are not provided with proper identification means to instruct the user of the proper denomination to be placed into the holder and, consequently, this results in improper usage of the holders. Furthermore, some known holders are bulky and not nestable and are therefore awkward to handle and store and when consisting of more than one part, some of its parts become lost, rendering the holder entirely non-usable.

A still further disadvantage of some known holders is that some of these do not permit a precise number of coins to be stored therein and will permit the insertion of one or more additional coins above a predetermined quantity, thus permitting errors to occur and necessitating counting the coins before placing same in the holder. Furthermore, some holders are not of a proper structural design and fail in transit, resulting in loss of money and errors in accounting.

SUMMARY OF INVENTION

It is a feature of the present invention to provide a re-usable transparent coin holder which substantially overcomes all of the above-mentioned disadvantages.

A still further feature of the present invention is to provide a re-usable transparent coin holder for holding a precise number of coins in close fit therein and permitting coins to be inserted and removed quickly without the necessity of counting same and providing a correlation between the denomination and the proper size of holder.

A further feature of the present invention is to provide a re-usable transparent coil holder which is nestable, when not in use, and which does not have any loose parts.

A further feature of the present invention is to provide a re-usable transparent coin holder which is easy to use and does not require a pre-assembly thereof.

According to the above features, from a broad aspect, the present invention provides a re-usable transparent coin holder comprising two open-faced receptacles formed from a transparent plastics material. The receptacles are interconnected along a common edge and each receptacle has a substantially semi-cylindrical side wall. A substantially semi-circular end wall is provided at opposite ends of each side wall. Each end wall slopes outwardly towards a top edge of the receptacle and an end rib is provided in the end wall of at least one of the receptacles and disposed adjacent at least a portion of the side wall and extending transverse to the side wall whereby to retain an exact quantity of coins when stacked side-by-side in close fit across the side wall and transverse to the plane thereof between the end walls. The side walls of the receptacles form one or more closed hollow cylindrical compartments when the receptables are folded together from the common edge and secured in juxtaposition.

BRIEF DESCRIPTION OF DRAWINGS

A preferred embodiment of the present invention will now be described with reference to the examples thereof as illustrated in the accompanying drawings in which:

FIG. 1 is a plan view of an example of the reusable transparent coin holder of the present invention and shown in its non-use condition;

FIG. 2 is an end view of FIG. 1;

FIG. 3 is an end view of the coin holder in its used condition;

FIG. 4 is a front view of FIG. 3;

FIG. 5 is a perspective view of a further example of a re-usable transparent coin holder of the present invention;

FIG. 6 is an end view of the coin holder of FIG. 5, but shown in a completely open position and as molded and in its nesting state;

FIG. 7 is a fragmented cross-section view along cross-section lines 7—7 of FIG. 6; and FIG. 8 is a fragmented cross-section view along cross-section lines 8—8 of FIG. 6.

DESCRIPTION OF PREFERRED EMBODIMENTS

Referring now to the drawings, and more particularly to FIGS. 1 to 4, there is shown generally at 10 an example of the re-usable transparent coin holder of the present invention. The holder hereinshown is formed from a sheet 11 of transparent plastic material having molded therein two open-faced receptacles 12. Each receptacle 12 has one or more substantially semi-cylindrical cavities 13. The cavities 13 are disposed in a side-by-side relationship and define a common dividing wall 16 between them. Transverse end walls 17 are provided at opposed ends of each cavity 13 and define a straight outer edge 18 extending on the diametrical plane of the cavities.

To add rigidity to the holder 10, a peripheral flange 19 extends diametrically outward of the receptacles 12 from at least the outer edges of the side wall 20 of the receptacle 12 and the straight outer edge 18 of the end walls 17 at opposed ends of the sheet 11.

As seen in FIG. 2, the dividing wall 16 has a top edge 21 extending in a plane below the common plane of the peripheral flange 19 to add stability and rigidity to the cavities in the receptacles.

The receptacles 12 are positioned end-to-end to one another and spaced closely at their adjacent ends to define a common folding edge or hinge 14 therebetween. A hinge line 15 is molded across the peripheral flange 19 axially aligned with the hinge 14 to facilitate hinging one receptacle 12 in juxtaposition to the adjacent receptacle 12'.

Attachment means is provided to detachably secure the receptacles 12 at an opposed edge of the receptacles to the hinge 14. An example of the attachment means is shown in FIG. 1 and consists of a tab 30 formed integral with the peripheral flange 19 and extending outwardly of the transverse end wall 17 of the cavities 13 along the edge 18. A folding flap 31 is formed integral with the peripheral flange 19 and extends outwardly from the end walls 17' of the cavities 13'. The folding flap 31 is approximately twice the width of the tab 30 and has a fold line 32 extending longitudinally and centrally of the flap whereby the outer flap portion 33 may be folded over the tab 30 when the receptacles 12 and 12' are juxtaposed as shown in FIG. 3.

As shown in FIG. 1, the end walls 17 or 17' of each cavity 13 or 13' are outwardly sloping toward the open face to permit clearance of the end walls 17 or 17' of one receptacle 12 or 12' from end one of coins stacked in juxtaposition along the entire length of the cavities 13 or 13'. The tapering end wall will permit the juxtaposition of the semi-cylindrical cavities of one of the receptacles over the coins stacked in the cavities of the other receptacle without hindrance or distortion of the end walls. Also, the sloping walls 17 permit nesting of the holders when not in use.

The length of the cavities 13 or 13' is predetermined to receive a specific quantity of coins of a predetermined denomination. Because of the flexibility of the transparent plastic material sheet 11, and the provision of an end rib 17'' in each end wall 17 disposed adjacent the side wall of the cavities 13 and 13' and extending transversely thereto, it is impossible to place a coin in excess of the predetermined quantity within one of the cavities. When an excess coin is pushed into a predetermined quantity of juxtaposed coins, the end one of the coins will spring out of the cavity due to the flexion of the sloping portion 17''' end wall 17 or 17' due to the distortion of the material of the plastic sheet 11.

In order to secure the attachment means, herein the flap 31 and tab 30, a staple 34 may be positioned in the flap as shown in FIG. 4. Other type fasteners may be used for this purpose, such as glue or adhesive tape. Further, in order to identify a coin holder with the proper denomination of coins to be placed therein, an identification marking 35 is provided on the sheet 11. The marking consists of a transparent colour strip extending across one of the receptacles 12. Alternatively, the entire holder 10 may be made from a transparent plastic having a colour pigment therein.

Referring now to FIGS. 5 to 8, there is shown a further example of the coin holder of the present invention. As hereinshown, the coin holder 50 is also molded from a sheet of transparent plastic material and consists of two open-faced receptacles 51 each interconnected along a common edge 52 and having a substantially semi-cylindrical side wall 53 each having semi-circular end walls 54.

The attachment means is herein constituted by a flange 55 extending outwardly of one of the side walls 53 of one of the receptacles 51 from a diametrically disposed edge 56. Herein, the edge 56 is provided with a hinged rib 57 which facilitates folding the flange 55 over the outer face 53' of the opposite receptacle 53 and accommodating a short structural flange 58 extending diametrically outward from a top edge of the side wall of the outer receptacle 51'. One or more longitudinal expansion ribs 59 are formed longitudinally across the flange 55 and disposed parallel between the edge 56 or rib 52 and the plurality of cavities 60 which are molded adjacent the end edge 61 of the flange. A plurality of protrusions 62 are formed in the side wall 53 of the receptacle 51' and spaced on a long axis thereof lying on the apex of the semi-cylindrical side wall 53 or at 90° to the plane of the opening of the receptacle. When the receptacles 51 and 51' are juxtaposed, the flange 55 is folded over the outer surface 53' of the receptacle 51' and the protrusions 62 are received in a respective cavity 60 of the flange. The position of the cavity 60 on the flange 55 are such that when the cavities are aligned with the protrusions and the protrusions pressed into the cavities, the ribs 59 will permit a slight expansion whereby in its secured position, a retention force will be exerted on the protrusion received in the cavities by the ribs 59. Thus, a more secure attachment means is provided.

Referring now more particularly to FIGS. 6, 7 and 8, there is shown the construction of the end walls 54 of each receptacle. As can be seen, the end walls 54 slope outwardly toward a top edge of the receptacle in a sloping portion 63 thereof. An end rib portion 64 is formed in the end walls 54 of at least the receptacle in which the coins 65 are intended to be firstly positioned. This rib portion 64 extends transverse to the side wall 51 and/or 51' in at least a portion thereof, although hereinshown fully along the interconnecting edge of the end wall 54 and the side walls 51 or 51'. The distance between adjacent end ribs 64 of a receptacle 54 is precisely the distance required to stack a predetermined quantity of coins of a predetermined denomination therein. Although the end walls have a sloping portion 63, it is not possible to insert an extra coin in the holder as there will be no spacing between the end ribs 64 and the resiliency in the plastics material of the sloping portion of the side wall 63 will not permit the coin to be inserted in the receptacle.

A plurality of structural ribs 66 are provided in the sloping portion 63 of the end walls 54 to add rigidity. Further, the end walls are provided with a structural flange 67 to add further structural rigidity to the receptacles, as the coin holder is formed of a thin plastic vinyl material having a thickness of approximately 7 mil. The purpose for providing an end wall 54 with a sloping portion 63 is to permit the nesting of the coin holders, one within the other, when in their non-used molded state, as shown in FIG. 6.

As further shown in FIG. 6, the common edge 52 is provided with a hinge rib 68 to facilitate hinging of the receptacles to juxtapose them. Also, this figure illustrates that the cavities 60 and the protrusion 62 are both molded by male plugs provided in the mold (not shown) whereby they have substantially the same distribution of plastics material thereabout to have substantially the same resistance. This provides for a better securement between the cavities and the protrusions.

Although not shown, the outer surface of the side wall 51 may be molded with a rough texture in at least a portion thereof whereby when a plurality of such coin holders are strapped together by an elastic band, they provided better retention and do not slip out of such attachment. The protrusions resulting from the outer surfaces of the cavities 60 will also provide retention, as an elastic band would also engage between these, but these are now on the outer surface of the opposite receptacle of each coin holder. Further, although not shown, in order to identify proper denomination of coins to be inserted in a holder, the plastics material of the entire holder may have a color pigment therein, each color being associated with a denomination.

In a modification of the example shown in FIG. 5, the attachment means may be comprised by merely a piece of tape material bridging both outside edges 56 and 56' of the receptacles when juxtaposed and in such case, the flange 55 would not be necessary. Of course, the end walls 54 would have the same configuration and the advantage of the coin holder would also be provided. However, the attachment means constituted by the flange 55 is a preferred attachment means, in view of the advantages provided thereby and mentioned hereinabove.

It is within the ambit of the present invention to provide any obvious modifications of the examples of the preferred embodiment described hereinabove, provided such modifications fall within the scope of the broad claims appended hereto.

I claim:

1. A re-usable cylindrical transparent coin holder comprising two open-faced receptacles formed from a transparent plastics material, said receptacles being interconnected along a common edge, each receptacle having a substantially semi-cylindrical side wall, a substantially semi-circular end wall at opposite ends of each said side wall, each end wall of at least one receptacle being integral with said side wall and includes on end rib extending inwardly from and normal to said side wall, said end wall having a portion sloping outwardly from said end rib toward the free edge of said end wall whereby to retain an exact quantity of said coins when stacked side-by-side in close fit across said side walls and transverse to the axial plane of said cylindrical holder, said side walls of said receptacles forming a closed hollow cylindrical compartment when said receptacles are folded together from said common edge and secured in juxtaposition.

2. A coin holder as claimed in claim 1 wherein said end rib is provided in each end wall of each receptacle and extends entirely along said side wall transversely thereto.

3. A coin holder as claimed in claim 2 wherein said receptacles are secured in juxtaposition by attachment means whereby said receptacles are detachably securable.

4. A coin holder as claimed in claim 3 wherein said attachment means is constituted by a flange extending outwardly of a side wall of one of said two receptacles from an edge thereof opposite said common edge, two or more cavities in said flange spaced on a long axis thereof and positioned to receive in friction fit a respective one of two or more protrusions formed in the other of said two receptacles and spaced on a long axis thereof lying on the apex of said semi-cylindrical side wall.

5. A coin holder as claimed in claim 3 wherein said attachment means is constituted by a tab extending outwardly of an end wall of one of said two receptacles from an edge thereof opposite said common edge, and a folding flap extending outwardly of an end wall of the other of said two receptacles adjacent from an edge thereof opposite said common edge, said tab being receivable between opposed walls of said folding flap and securable therebetween, said tab and folding flap being integrally formed with their respective receptacles.

6. A coin holder as claimed in claim 3 wherein said attachment means is an adhesive tape extending over an outside surface of a side wall of each receptacle and across said edge of said receptacles opposite said common edge when juxtaposed.

7. A coin holder as claimed in claim 2 wherein each said end walls is provided with structural ribs integrally molded, said outwardly sloping of said end walls permitting clearance of said end walls of one receptacle with end coins positioned adjacent said end wall of the other of said receptacles and further permitting nesting of holders one within the other when not in use.

8. A coin holder as claimed in claim 2 wherein at least one of said receptacles is molded with permanent indentification markings to identify predetermined quantities of coins retained in said holder when not filled entirely with coins.

9. A coin holder as claimed in claim 2, wherein a peripheral structural flange extends diametrically outward of said receptacles from at least the free edge of said side wall opposite said common edge and the free edge of said end walls to structurally stabilize said receptacles.

10. A coin holder as claimed in claim 2, wherein said plastics material is an acetate plastic vinyl of 7 mil thickness and being colored to identify the coin denomination to be retained in said holder.

11. A coin holder as claimed in claim 2, wherein said common edge has a hinge rib formed therealong.

12. A coin holder as claimed in claim 4 wherein said receptacle having said flange is formed with at least a roughened outer surface in an apex region of said side wall.

13. A coin holder as claimed in claim 4 wherein one or more longitudinal expansion ribs are formed longitudinally across said flange between said edge from which said flange extends and said cavities in said flange whereby to exert a retention force on said protrusions received in said cavities.

* * * * *